United States Patent [19]

Landis et al.

[11] 4,451,225

[45] May 29, 1984

[54] FLAME SAFEGUARD SEQUENCER HAVING INTERLOCK CHECKING MEANS

[75] Inventors: William R. Landis, Bloomington; Paul B. Patton, Columbia Heights, both of Minn.

[73] Assignee: Honeywell Inc., Minneapolis, Minn.

[21] Appl. No.: 462,172

[22] Filed: Jan. 31, 1983

[51] Int. Cl.[3] ..... F23N 5/24

[52] U.S. Cl. ..... 431/14; 431/18; 431/24

[58] Field of Search ..... 431/13, 14, 18, 24, 431/26, 29; 371/62; 340/577

[56] References Cited

U.S. PATENT DOCUMENTS

| | | | |
|---|---|---|---|
| 3,644,748 | 2/1972 | Lord | 431/26 X |
| 3,814,569 | 6/1974 | Jacobsz | 431/29 |
| 4,116,613 | 9/1978 | Matthews | 431/26 X |
| 4,399,537 | 8/1983 | Jones | 431/24 X |

FOREIGN PATENT DOCUMENTS

| | | | |
|---|---|---|---|
| 2065944 | 7/1981 | United Kingdom | 431/24 |
| 2082360 | 3/1982 | United Kingdom | 431/24 |

*Primary Examiner*—Samuel Scott
*Assistant Examiner*—Margaret A. Focarino
*Attorney, Agent, or Firm*—Alfred N. Feldman

[57] ABSTRACT

A flame safeguard sequencer incorporates an interlock checking means that verifies the proper status of the start or preignition interlocks in the burner system and the run interlocks of the burner system. In the event that an interlock opens during a period of time when it should not be open, the system can limit the operation of the sequence to a short time period (typically 30 seconds) to allow the interlock to reestablish a normal running state. If the correct state is reestablished, the system continues normal operation. If the correct state is not reestablished, the system is shut down on safety and a coded fault-hold indicator advises a serviceman of where to find the problem.

7 Claims, 5 Drawing Figures

FIG. 3 KEY

FLAME SAFEGUARD SEQUENCER HAVING INTERLOCK CHECKING MEANS

CROSS-REFERENCE TO RELATED APPLICATION

The present application relates to subject matter disclosed in U.S. patent application Ser. No. 456,952, filed on Jan. 10, 1983, by William R. Landis and Paul B. Patton, and assigned to the assignee of the present application.

BACKGROUND OF THE INVENTION

In the operation of various types of burner systems, it is common practice for the systems to employ a number of limit switches and interlock switches. There are various classes of interlock and limit switches. Some of these switches are closed at all times during operation, some are closed during a portion of the operation, and others must be closed before an attempt to start operation.

In a burner control system, these switches are identified by their location within the control system's wiring diagram. For example, recycle interlocks cause a normal burner operating sequence to occur when they open and close. A burner's operating sequence cannot start if its start interlocks are open when a call for heat occurs. If a burner's sequencing control continues to test for closed start interlocks until the ignition sequence begins, the start interlocks are renamed preignition interlocks. Running interlocks are tested soon after a burner's operating sequence begins and are tested during the remaining call-for-heat period. Open running interlocks cause the burner's sequencing control system to return to the beginning of its operating sequence and wait for interlock re-closure. If a burner's sequencing control is designed to execute a safety shutdown upon opening of a running interlock, that interlock is renamed a lockout interlock. Burner control systems provide for three classes of limit and interlock switches: recycle interlocks, start or preignition interlocks, and running or lockout interlocks.

In existing flame safeguard sequencers the program is typically operated by a motor driven cam and relays, and no provision is made for annunciating time delays in the event that any of the interlocks are found in an incorrect position during the portion of the cycle in which they are relied on. The most common types of flame safeguard programmers or sequencers typically either recycle, hold the sequence, or lock out when an incorrect interlock state is determined to be present. This can cause unnecessary shut downs and time delays in operating heating and process control equipment.

SUMMARY OF THE INVENTION

The present invention is directed to an interlock checking means that verifies the proper position of start or preignition interlocks and running interlocks. The interlock checking means provides short time limits, typically up to thirty seconds, that can be used to allow the interlocks to return to a normal state before the burner sequence is caused to be interrupted, shut down and an alarm sounded. This type of delay allows for momentary interruptions in the interlock structure before providing annunciation that the normal burner sequence is being delayed by an open interlock.

The present novel flame safeguard sequencer further has a coded fault-hold indicator means which includes an alpha-numeric display and a group of light emitting diode indicators. This indicator means is capable of indicating the existence of an interlock malfunction and subsequently displaying it on an alpha-numeric display that can be used for trouble shooting in locating the particular interlocks involved, and why the flame safeguard sequencer subsequently shut down the burner.

BRIEF DESCRIPTION OF THE DRAWINGS

FIG. 3 is a key for the layout or interconnection of FIGS. 3A and 3B, and;

DESCRIPTION OF THE PREFERRED EMBODIMENT

Figure 1:
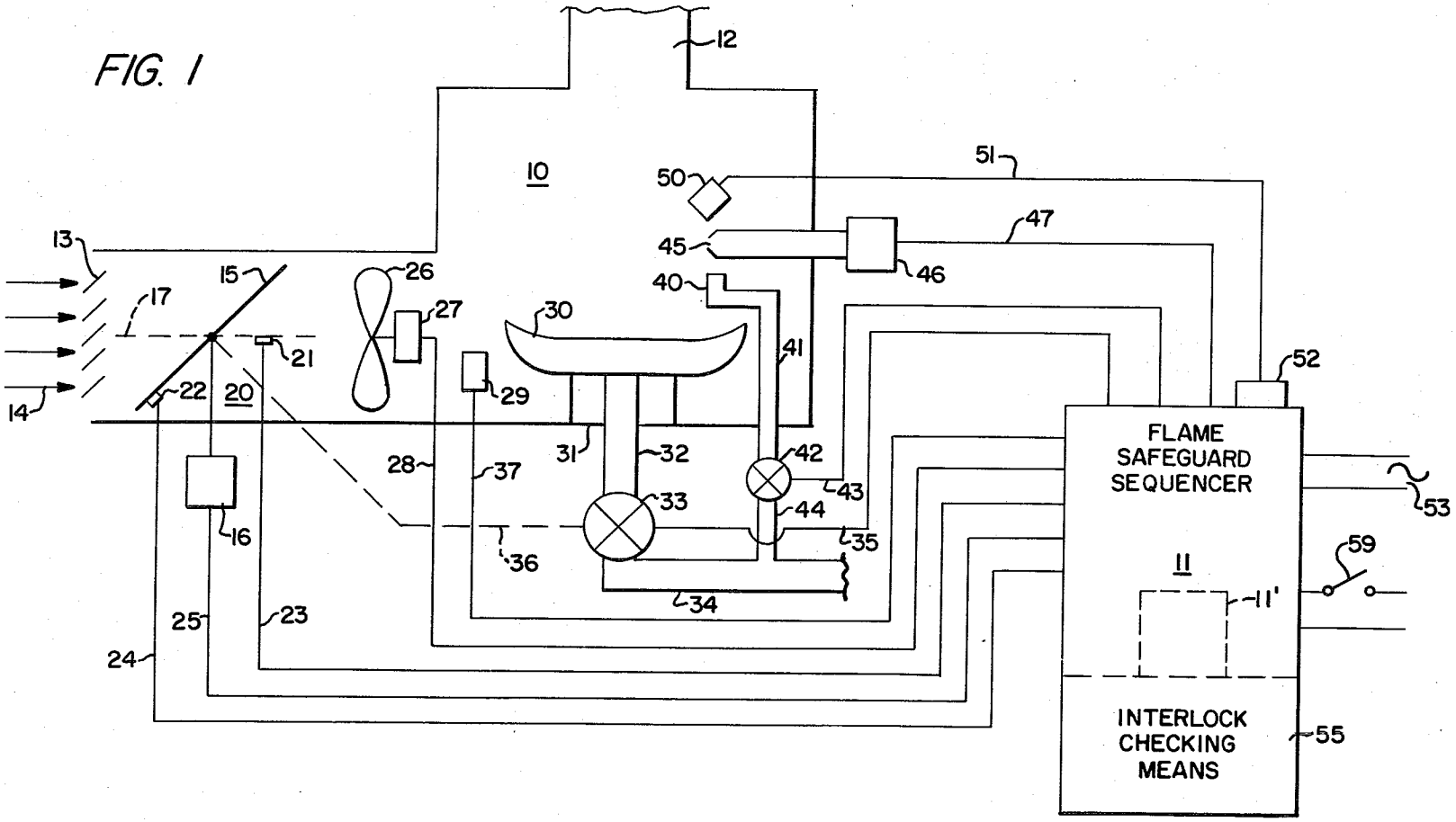
FIG. 1 is a schematic representation of a fuel burner including the novel sequencer.

In FIG. 1 there is schematically disclosed a fuel burner 10 which is operated under the control of a flame safeguard sequencer 11. The fuel burner 10 could be any type of burner such as a gas fired burner, an oil fired burner, or a burner which utilizes both fuels. The flame sequencer 11 typically would operate the fuel burner 10 in any conventional sequence such, as example, a prepurge, trial for ignition, trial for main flame, main flame run, and a postpurge sequence The sequencer 11 also would include an annunciator and/or sequence status indicator means 11' that will be discussed in connection with FIG. 2. The disclosed sequencer 11 includes a microprocessor or microcomputer that properly sequences the unit. The fuel burner is disclosed as having a stack 12 and an air inlet 13 with air flow schematically indicated at 14. The air inlet 13 is regulated by a damper 15 that is driven by a damper drive motor means 16. The damper 15 is shown in a semiclosed position which will be referred to as a low fire position. A second position disclosed at 17, with the damper open, will be referred to as a high fire position.

A high fire and low fire switch means is disclosed at 20 and includes a pair of switches 21 and 22. The switch 21 is activated by the damper 15 when it reaches the position shown at 17. The switch 22 is activated by the damper 15 in the position shown. Both of the switches 21 and 22 are normally open electrical switches which close to change an electrical state for the flame safeguard sequencer 11 to indicate the proper operation of the damper 15 between the position shown and the position 17. The switch 21 is connected by conductors 23 to the flame safeguard sequencer, while the switch 22 is connected by the conductors 24 to the flame safeguard sequencer 11. The damper drive motor means 16 is connected by conductors 25 to the flame safeguard sequencer 11 so that the motor means 16 can be operated to drive the damper 15 to in turn properly actuate the switches 21 and 22.

The fuel burner 10 further has a fan or air source 26 driven by a conventional motor 27 that is connected by conductors 28 to the sequencer 11. An air flow or sail switch 29 is proved to sense the actual flow of air and is connected by conductors 37 to the sequencer 11. The fan 26 provides the burner 10 with an air flow 14 from the inlet 13 to the stack 12 to provide combustion air and to provide a prepurge and postpurge operation of the burner, when required, and is proven by switch 29.

A burner is schematically disclosed at 30 mounted to the bottom 31 of the fuel burner 10 and supplied by a pipe 32 from a valve 33 connected to a fuel line 34. The valve 33 is connected by electric conductors 35 to the sequencer 11, and also can be connected by a linkage 36 to the damper 15. This is done in order to adjust the flow of fuel through the valve 33 with the position of the damper 15, in addition to controlling the fuel flow through the valve 33 in an off-on manner by electric conductors 35.

A pilot burner 40 is mounted at the main fuel burner 30 and is connected by a pipe 41 to a pilot fuel valve 42 that has electrical connection means or conductors 43 connected to the sequencer 11. The pilot fuel valve 42 is connected by a pipe 44 to the main fuel pipe 34, as would be used in a gas only installation. The particular type of fuel for the main burner 30 and the pilot burner 40 is not material to the present invention, and the presently disclosed arrangement is purely schematic in nature in order to provide an explanation of an operation of the present invention.

The fuel burner 10 is completed by the provision of an ignition source 45 disclosed as a pair of spark electrodes that are connected to a spark generating means 46 that is connected by conductors 47 to the sequencer 11 to receive power and control. Also provided is a flame sensor means 50 that is connected by conductors 51 to a flame sensor amplifier 52. The amplifier 52 can be designed to plug into the flame safeguard sequencer 11. The sequencer 11 is energized from a conventional two conductor, one-side grounded line source at 53. The flame safeguard sequencer 11 has a normal sequencing portion, an annunciator and sequence status indicator means 11', and has a further portion 55 that provides interlock checking means for the burner, and will be described in connection with the description of a flow chart of the sequence of operation of the novel portion of the present unit as disclosed in FIGS. 3A and 3B. The burner 10 is activated upon the operation of a controller 59.

Figure 2:
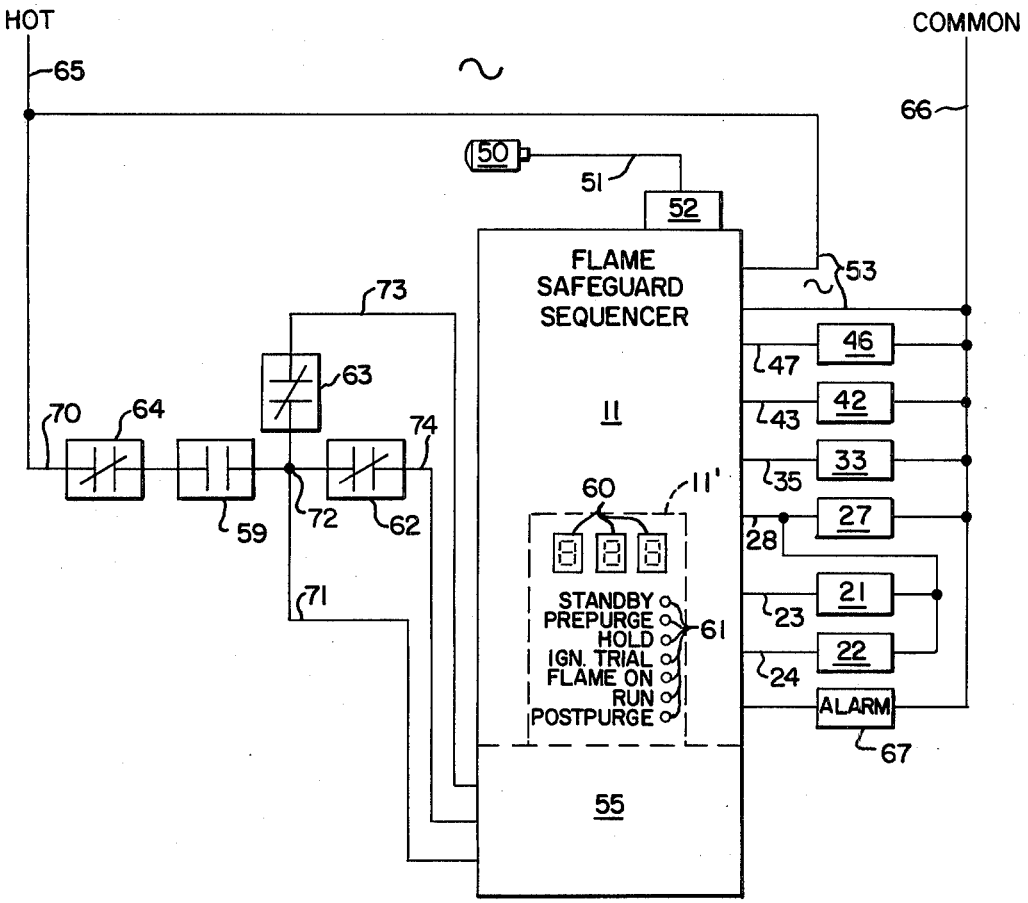
FIG. 2 is a schematic representation of a sequencer connected to a burner system including the interlocks.
Figure 2:
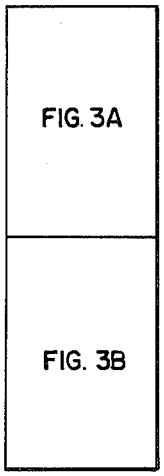

In FIG. 2 there is disclosed a flame safeguard sequencer 11 connected for the control of the fuel burner 10 and similar reference numbers have been used for the elements common to FIG. 1. The annunciator and sequence status indicator means 11' is shown as part of the flame safeguard sequencer 11 and includes alphanumeric display elements 60 which are used to provide a code, as will be explained later in the present disclosure. Also included in means 11' are seven sequence status indicators 61, which in the preferred embodiment would be light emitting diodes that identify a plurality of possible sequence status conditions for the burner. These conditions have been specifically identified as "standby", "prepurge", "hold", "ignition trial", "flame on", "run" and "postpurge". The particular functions that are identified could vary and are meant to be illustrative only.

The flame safeguard sequencer 11 is powered at 53 from a conventional two-wire one-side grounded power source represented by conductors 65 and 66. Power is also supplied via conductor 70 through recycling limits means 64 and controller 59 to node 72. Node 72 provides power to the start or preignition interlock means 63 and conductor 73, running interlock means 62, and burner controller monitor (via conductor 71). The switches or limit means 62, 63, and 64 are all normally closed switches when the proper condition for operation of the fuel burner is present. As is previously mentioned, these switches typically are switches such as pressure switches, high temperature switches, low-water-cutoff switches, air flow switches, and main fuel valve-stem position switches. Power conductors at 53 supply power to various units such as the alarm 67, the damper switches 21 and 22, and the blower motor 27. The fuel valve 33, the pilot valve 42 and the ignition source 46 receive power from conductor 74. All of the interconnections thus described merely show how the flame safeguard sequencer 11 is interconnected to the equipment previously disclosed in FIG. 1.

With the interconnection shown of the various limits and interlock switches, along with the controller, the flame safeguard sequencer is adapted for control of a complete fuel burner system with that fuel burner system capable of operating start or preignition interlock means, run interlock means, damper means, ignition means, fuel supply means, and flame sensor means to operate the fuel burner system in a complete and safe manner.

Figure 3A:
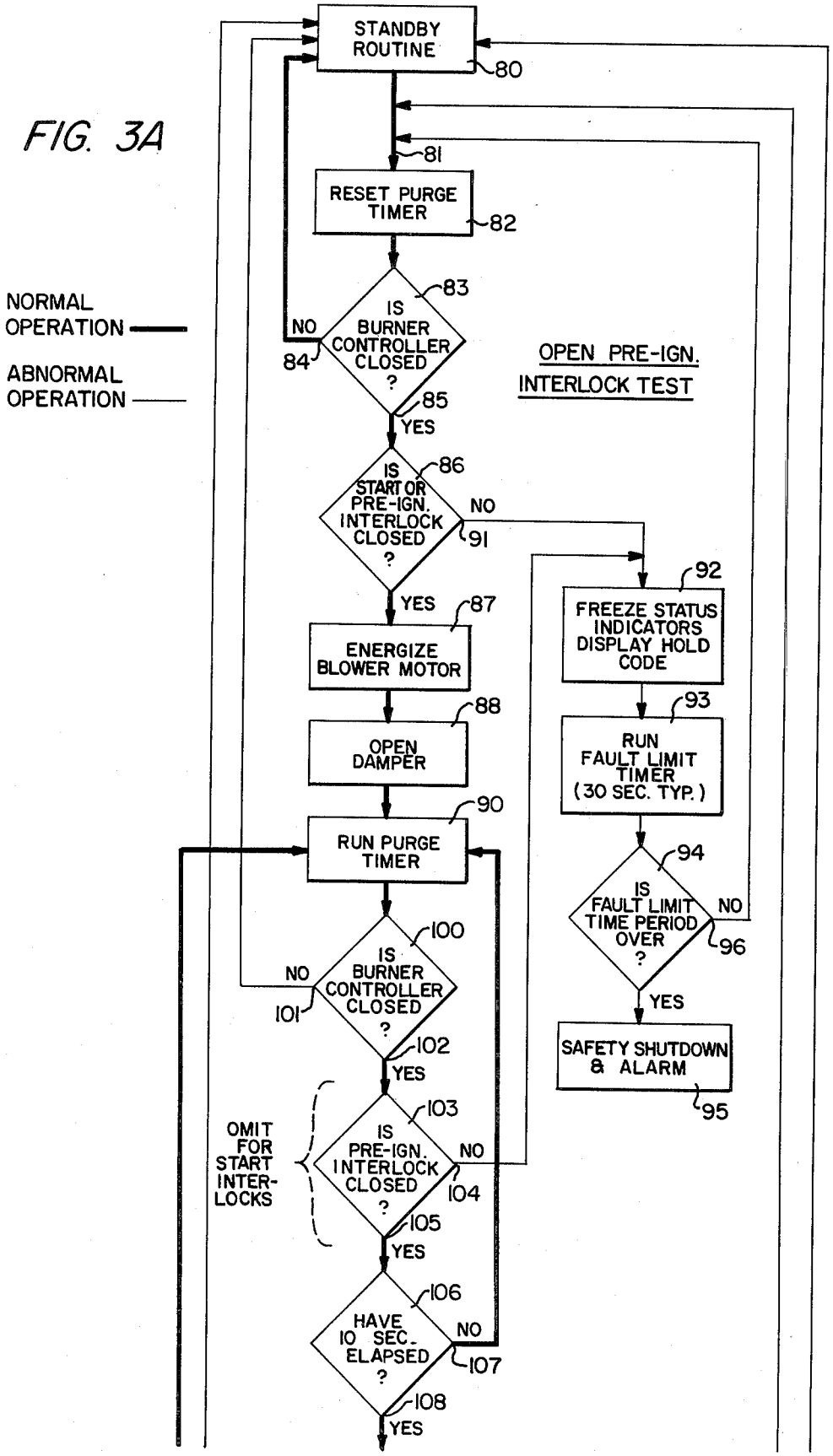
FIGS. 3A and 3B are a flow chart of operation of a portion of the novel burner control system.
Figure 3B:
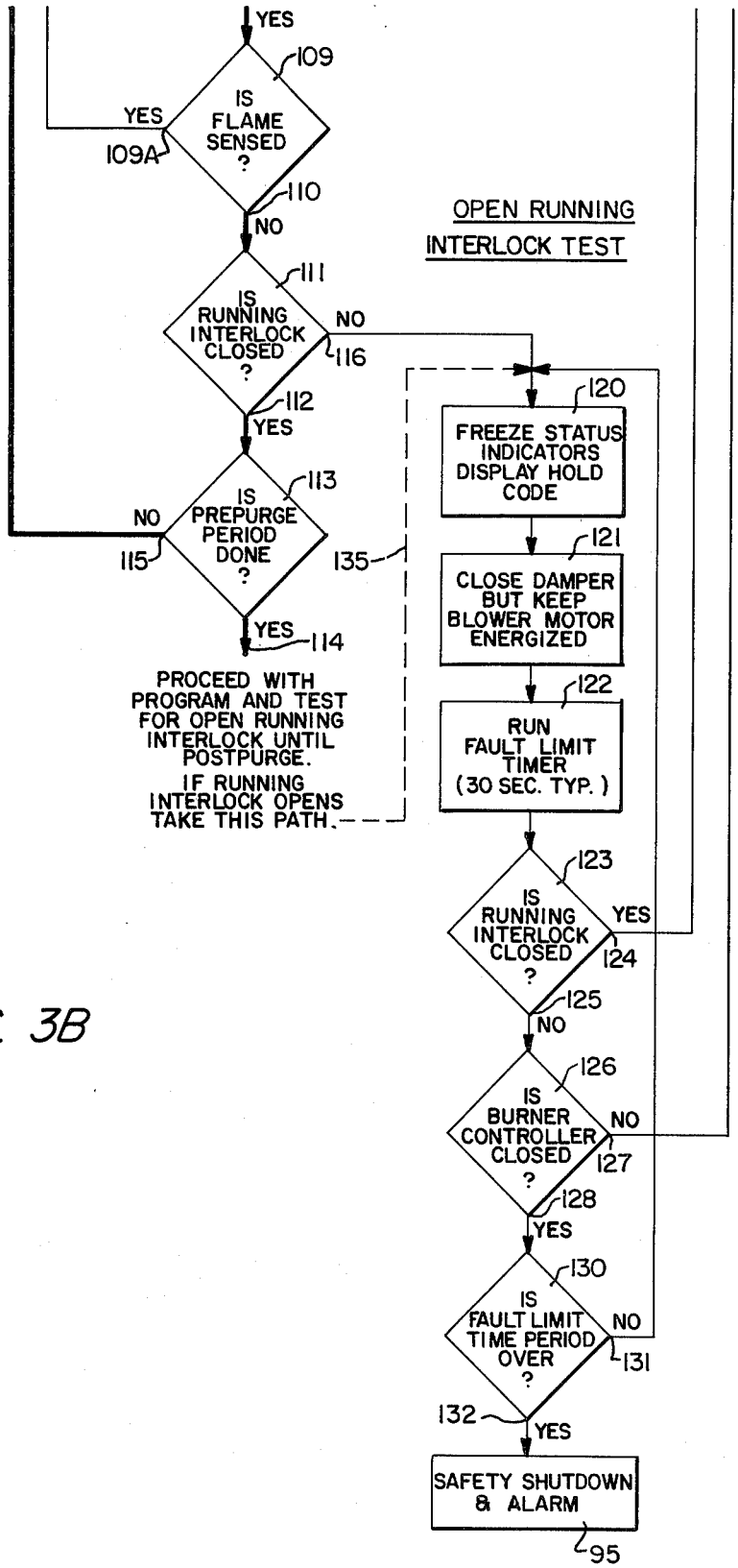

In FIGS. 3A and 3B there is disclosed a flow chart of the novel operation of the system disclosed in FIGS. 1 and 2. The flow chart of FIGS. 3A and 3B basically deals only with the portion of operation of the system from a standby routine 80 to the system reaching the end of a normal purge period and then going into operation through the run cycle when the running interlocks are still checked. The standby routine 80, in its normal operation, progresses at 81 to reset purge timer 82, and to determine at 83 if the controller 59 for the burner is closed. If it is not closed at 84, the routine starts over again thereby continuously checking for standby and normal operation. If the burner controller 59 is closed as at 85, the system proceeds to determine at 86 if the start or preignition interlocks 63 are closed. If they are closed, the system energizes the blower motor at 87, begins to open the damper at 88, and initiates a purge timer 90.

In the event that the preignition interlock is not closed at 91, the system at 92 freezes the status indicators and displays a "hold" code by illuminating the proper light emitting diode 61 in the annunciator and sequence status indicator means 11'. The sequence then proceeds to run at 93 a run fault limit timer, which typically would be a 30 second timer. If the fault limit time period ends at 94 and the start or preignition interlock 63 is still open, the system proceeds to 95 and a safety shut down and alarm occur. If the fault limit time period is not over at 96, the system recycles to repeatedly check the status of the preignition interlock at 86. At this point the invention has provided an indication that the start or preignition interlock 63 is open and it will provide an alarm if the condition lasts longer than the fault limit time. If the preignition interlock 63 fails to close within the fault limit timer period, the system shuts down, locks out, and displays an alpha-numeric code in the indicator means 11' thereby indicating to a serviceman where the problem lies.

In the event that the purge timer 90 continues to operate, the system again checks at 100 to determine if the burner controller 59 is closed. If it is not closed at 101, the routine is restarted. If it is closed at 102, and if the system is programmed for preignition interlocks, the preignition interlock check is again made at 103 and if it is not appropriate the freeze status indicator 92 is again caused to function with ultimate safety shut down and alarm if the interlock does not close within the fault limit time.

If the preignition interlock check at 103 is found to be correct at 105, the system determines if 10 seconds of prepurge time have elapsed at 106. If 10 seconds have not elapsed, purge timing continues via 107. If 10 seconds have elapsed at 108, the system begins to check for a flame at 109 and if a flame is sensed at 109A, the system is restarted. This is a function of the system disclosed in the application cross-referenced at the introduction of the present application.

If flame is not sensed, which is the normal at 110, the system then progresses to start a check of the running interlocks 111. The running interlocks must be closed for the system to progress at 112 into a normal purge period at 113. If the normal purge period is accomplished the system goes into ignition trials at 114 where it progresses through the run cycle to postpurge, as is indicated in the text of the flow chart. In the event that the purge period is not complete at 115, the system loops to run purge timer 90 and this cycle continues until the purge period test 113 provides a "yes" output at 114 to allow the system to continue in a normal fashion.

In the event that a running interlock is not closed at 111, a "no" output is provided at 116 at which time a freeze status indicator routine 120 is brought into play and the annunciator and sequence status means 11' again indicates the appropriate type of fault and where in the cycle it occurred. The freeze indicator 120 then allows the system to progress at 121 to close the damper 15 while keeping the blower motor 27 energized. The damper closing is an energy saving function that is not typical of the previously available flame safeguard sequencers. The system keeps the blower motor 27 energized to maintain closure of the airflow switch 29 which is one of the running interlocks. The fault limit timer 122 operates again. The run interlock is checked once again at 123. If it is found at 123 that the run interlock has closed, a "yes" output is provided at 124 and the system restarts the prepurge sequence.

If the run interlock is checked at 123 and is found to still be open, a "no" output is generated at 125 and a check is made at 126 to determine if the burner controller is still closed. If it is not closed at 127 the system returns to the standby routine 80. If it is closed at 128, the system progresses at 130 to measure whether the fault limit time period is over (typically 30 seconds). If it is not over at 131, the portion of the routine through the freeze status indicator 120 is reactivated. If the time period has expired at 132, the system goes to a safety shut down and alarm 95.

The routine just described tests the run interlock structure and provides an alpha-numeric display at 60 along with an energized light emitting diode 61 to indicate where the trouble in the system is. If the fault persists until the fault limit time delay elapses, a safety shut down and alarm will occur. This allows the serviceman to promptly locate and correct the problem by directing him to the run interlocks. Prior art would not signal the operator of a running interlock fault, allowing greater heat loss until the problem was discovered.

As disclosed at the dotted path 135, the running interlock test runs during the entire operating period for the device, and in the event that a run interlock, such as interlock 62, opens during the operation of the system (when it should not be open), the system is able to automatically identify where the problem is and recycle if possible. If not possible, the system will operate in a safety shut down and alarm at 95, once again indicating to a serviceman where to locate the problem.

The novel interlock checking means accomplished by the present flame safeguard sequencer, along with its related annunciator and sequence status means 11' checks the system for the status of the start or preignition and run interlocks. If a failure in an interlock is sensed, the interlock checking means 55 will cause an appropriate action to occur within the flame safeguard sequencer 11 and will indicate where the problem is by the alpha-numeric display and the plurality of light emitting diode indicators of the annunciator and sequence status means 11'. If the problem clears itself within a specified time, typically 30 seconds, shut down of the system will be avoided. If the problem does not clear itself within a specified time, a safety shut down and alarm will occur that alerts the boiler operator.

The specific routine disclosed accomplishes an energy saving, a superior and more even control of temperature by ensuring more reliable operation, and is capable of locating certain types of faults. The specific routine can be readily altered for various types of burners and installations. As such, the flame safeguard sequencer 11 and its interlock checking means 55 can be configured in a number of different ways. The specific configuration of the flame safeguard sequencer and the interlock checking means is limited only by the scope of the appended claims.

The embodiments of the invention in which an exclusive property or right is claimed are defined as follows:

1. A flame safeguard sequencer for the control of a fuel burner system upon the operation of controller means for said fuel burner system with said system having start or preignition interlock means, run interlock means, damper means, ignition means, fuel supply means, and flame sensor means, including: a flame safeguard sequencer adapted to be connected to said interlock means, said damper means, said ignition means, said fuel supply means, and said flame sensor means to operate said means to properly purge, ignite and operate said fuel burner system in a predetermined timed sequence upon operation of said controller means; said flame safeguard sequencer including interlock checking means; said interlock checking means including time delay means to limit the operation of said flame safeguard sequencer for up to a fixed interval of time in the event that any of said interlock means is determined by said interlock checking means to be in an incorrect state; said interlock checking means releasing the hold of said operation of said sequencer upon said incorrect state of said interlock means clearing before said fixed time interval expires; said time delay means limiting the operation of said sequencer up to said fixed time interval; said interlock checking means providing a shut down of said burner in the event said interlock means remains in an incorrect state longer than said fixed time.

2. A flame safeguard sequencer as described in claim 1 wherein said sequencer further includes annunciator and sequence status means; said incorrect state when determined by said interlock checking means being displayed by said annunciator and sequence status means as a hold display; and said interlock checking means converting said hold display of an incorrect state to a coded fault display when said burner is shut down by an interlock means remaining in an incorrect state longer than said fixed time.

3. A flame safeguard sequencer as described in claim 2 wherein said annunciator and sequence status means includes an alpha-numeric display and a plurality of light emitting diode indicators.

4. A flame safeguard sequencer as described in claim 1 wherein said flame safeguard sequencer includes a microcomputer to operate said fuel burner in said predetermined time sequence and to further operate said interlock checking means.

5. A flame safeguard sequencer as described in claim 4 wherein said start or preignition interlock means and said run interlock means include a plurality of electrical switches which are closed circuited when said interlock means are in a correct state for said burner to be operated.

6. A flame safeguard sequencer as described in claim 5 wherein said sequencer further includes annunciator and sequence status means; said incorrect state when determined by said interlock checking means being displayed by said annunciator and sequence status means as a hold display; and said interlock checking means converting said hold display of an incorrect state to a coded fault display when said burner is shut down by an interlock means remaining in an incorrect stage longer than said fixed time.

7. A flame safeguard sequencer as described in claim 6 wherein said annunciator and sequence status means includes an alpha-numeric display and a plurality of light emitting diode indicators.

* * * * *

UNITED STATES PATENT AND TRADEMARK OFFICE

CERTIFICATE OF CORRECTION

PATENT NO. : 4,451,225

DATED : May 29, 1984

INVENTOR(S) : WILLIAM R. LANDIS and PAUL B. PATTON

It is certified that error appears in the above-identified patent and that said Letters Patent is hereby corrected as shown below:

Claim 6, line 9, delete "stage" and insert --state--.

Signed and Sealed this

*Ninth* Day of *October 1984*

[SEAL]

*Attest:*

GERALD J. MOSSINGHOFF

*Attesting Officer*

*Commissioner of Patents and Trademarks*